United States Patent [19]

Seitz et al.

[11] Patent Number: 4,641,159

[45] Date of Patent: Feb. 3, 1987

[54] PROTECTIVE BARRIER AND METHOD OF PROVIDING SAME FOR THERMOSENSITIVE SHEET

[75] Inventors: Paul W. Seitz, Miamisburg; Maurice W. Lewis, Dayton; Stephen D. Lakes, West Carrollton, all of Ohio

[73] Assignee: NCR Corporation, Dayton, Ohio

[21] Appl. No.: 724,381

[22] Filed: Apr. 18, 1985

[51] Int. Cl.[4] ..... B41M 5/18

[52] U.S. Cl. ..... 346/200; 346/214; 346/216; 346/226; 427/152

[58] Field of Search ..... 346/200, 226, 214, 216; 427/150, 151, 152; 428/913, 914

[56] References Cited

U.S. PATENT DOCUMENTS 4,370,370 1/1983 Iwata et al. ..... 428/40
4,388,362 6/1983 Iwata et al. ..... 428/211
4,424,245 1/1984 Maruta et al. ..... 428/40
4,426,422 1/1984 Daniels ..... 428/352
4,444,819 4/1984 Maruta et al. ..... 346/209

FOREIGN PATENT DOCUMENTS 0029491 2/1982 Japan ..... 346/226

*Primary Examiner*—Bruce H. Hess
*Attorney, Agent, or Firm*—Wilbert Hawk, Jr.; Albert L. Sessler, Jr.; George J. Muckenthaler

[57] ABSTRACT

A thermosensitive sheet includes a support layer or substrate, a thermally reactive coating or layer on the substrate, and an impervious cellulose based layer on the thermally reactive coating. The thermally reactive coating acts as an adhesive for laminating the cellulose based layer and the substrate. A method of providing the protective barrier is also disclosed.

2 Claims, 2 Drawing Figures

PROTECTIVE BARRIER AND METHOD OF PROVIDING SAME FOR THERMOSENSITIVE SHEET

BACKGROUND OF THE INVENTION

In the field of product labeling, it has been common practice to apply the appropriate parameters such as content, weight, price and the like to the labels by means of printing apparatus utilizing ink or ink ribbons. It is further common practice to print machine readable indicia such as the bar code (now in use on the vast majority of products) on the product label by means of conventional ink printing apparatus. Meanwhile, the use of thermal printing on product labels has greatly increased in the manner of providing clear and well-defined printed characters and/or images.

The machine readable and human readable printing by use of thermal elements also has been expanded into the area of perishable goods which may be packaged in soft packages and stored in an adverse atmosphere that may affect the printing on the package. The wrapped products may include meat, poultry, fish, produce or the like which are subject to an environment containing water or water vapor (condensation) animal fat, oil, vinegar, blood, and alcohol, and it is commonly known that the printing on the labels for these products must be protected from exposure to such environmental elements to enable fast and correct reading of the printed matter.

Representative documentation in the field of protection for thermosensitive type sheets includes U.S. Pat. No. 4,370,370, issued to S. Iwata et al. on Jan. 25, 1983, and which discloses a thermosensitive recording adhesive label having a support sheet, a coloring layer of leuco dye and acidic material on the front side of the support sheet, a front barrier layer of polymeric material, a layer on the back barrier layer, and a disposable backing sheet peelable from the adhesive layer.

U.S. Pat. No. 4,388,362, issued to S. Iwata et al. on June 14, 1983, discloses a heat sensitive recording paper having a substrate, a color forming layer of leuco dye and acidic material on the substrate, and a protective layer of water soluble resin. A pattern is printed on the protective layer with ultraviolet setting type ink and an adhesive layer is formed on the back of the substrate with a releasable paper on the adhesive layer.

U.S. Pat. No. 4,424,245, issued to K. Maruta et al. on Jan. 3, 1984, discloses a thermosensitive recording type label sheet having a support, a coloring layer of leuco dye and acidic material on the front side, a barrier layer of water soluble polymeric material and water repellent wax material, and an adhesive layer on the barrier layer.

U.S. Pat. No. 4,426,422, issued to G. R. E. Daniels on Jan. 17, 1984, discloses distortion and chemically resistant heat transfer materials formed by a mixture of two interspersed polymers, one being an acid based polyester and the other an ethylene vinyl acetate copolymer. The labels resist alcohols, oils, detergents, inks and adhesives.

U.S. Pat. No. 4,444,819, issued to K. Maruta et al. on Apr. 24, 1984, discloses thermosensitive recording material having support material, a coloring layer of leuco dye and acidic material, and a protective layer of PVA with a saponification ratio of 70 to 85%.

SUMMARY OF THE INVENTION

The present invention relates to thermally printed sheets or like material and, more particularly, to means for protecting the printed matter from exposure to elements present in an adverse environment. The printed sheets are formed in the manner of labels provided for those products normally contained in wrapped packages, and the printed matter on the labels must be protected from adverse elements or material in the surrounding atmosphere in order to maintain the printing in clear and well-defined condition to enable machine and human reading of such printed matter.

The protective barrier of the present invention comprises a base sheet, substrate, or support member, a thermally reactive coating or layer on the support member, and a thin overlay sheet that is impervious to the elements or material present in such adverse environment.

The support member preferably is a sheet of paper or like material, and the thermally reactive coating includes a formulation having a color forming dye, a wax, and a binder. The formulation of the thermally reactive layer acts as an adhesive to laminate the support member and the protective overlay sheet. The overlay sheet is a capacitor tissue that is applied to the reactive layer immediately after application of such layer onto the support member.

In view of the above discussion, the principal object of the present invention is to provide protective means for machine and human readable, thermally printed matter.

Another object of the present invention is to provide protection of thermally printed images by means of a laminate-type overlay sheet.

An additional object of the present invention is to provide a thermally reactive coating on a substrate and an overlay sheet on the coating to protect thermally printed matter from elements in an adverse environment.

A further object of the present invention is to provide means for laminating a protective sheet over a thermal reactive layer which acts as an adhesive for the protective sheet and a support member.

Still another object of the present invention is to provide a method for protecting thermally printed matter by laminating a protective layer on a thermal coating over a supporting sheet in a single operation wherein the thermal coating is in a wet or like condition to act as an adhesive between the protective layer and the supporting sheet.

Additional advantages and features of the present invention will become apparent and fully understood from a reading of the following description taken together with the annexed drawing.

DESCRIPTION OF THE PREFERRED EMBODIMENT

Figure 1:
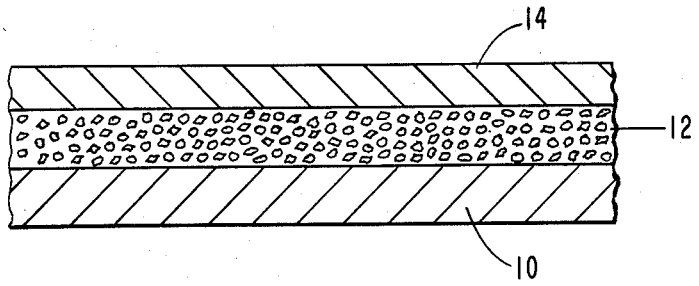
FIG. 1 is a sectional view of a thermally coated sheet incorporating the features of the present invention.

Referring now to the drawing, FIG. 1 illustrates a laminate which comprises a base sheet 10 of paper or like material. More specifically, the paper base sheet 10 has the following parameters and/or characteristics: a paper weight of 35 to 60 pounds per ream (24×36/500) having thickness in the range of 2.5 to 5 mils thick, a cross direction (CD) tensile strength of 15 pounds per inch minimum, a machine direction (MD) tear resistance of 50 grams minimum, a cross direction (CD) tear resistance of 60 grams minimum, and Gurley stiffness in the range of 50–100 MD, 30–60 CD.

The base sheet 10 supports a thermally reactive coating or layer 12 consisting essentially of a color forming dye, a wax, a bisphenol, a filler and a binder. The color forming dye may be one selected from the group of black, thermally reactive-type, dyes of the fluoran family. The wax may be one selected from the group of those waxes, such as the amide waxes, and preferably a mixture of octadecanamide and hexadecanamide waxes. The binder may be one selected from the group containing water soluble polymers such as polyvinyl alcohol, cellulose derivatives, casein, latices, starch, and gum arabic.

The overlay sheet 14 is a capacitor tissue made of highly refined cellulose pulp material and is preferably 8 to 10 microns (0.0003 to 0.0004 inches) thick. This results in an extremely high density, low porosity sheet that, in effect, forms essentially a film that is impervious to penetration by such adverse material, as alluded to above. The overlay sheet 14 is applied to the coating 12 in a single operation, as diagrammatically shown in FIG. 2, immediately following (3 to 6 seconds) application of the coating 12 by an applicator and spread evenly by a doctor blade 18 or the like onto the base layer 10 by means of a roller to eliminate wrinkles and secure alignment of the two sheets 10 and 14 together, however, without the use of pressure on the roller. The wet or like thermally reactive coating 12 serves as an adhesive to laminate the two sheets 10 and 14 which in such condition are trained over a roller 20 and dried in a dryer 22. The caliper or thickness of the overlay sheet 14 enables adequate and rapid heat transfer to the reactive layer 12 which results in clear and well-defined image development, and the overlay sheet is translucent to provide adequate showing of the image therethrough.

EXAMPLE I

The following example is a formulation of the various ingredients of the thermally reactive coating 12.

| Material | % by Weight | Range |
|---|---|---|
| Polyvinyl alcohol binder | 20 | 10–30 |
| 4,4 Iso-Propylidene Diphenol | 44 | 15–50 |
| Amide wax | 18 | 5–30 |

-continued

| Material | % by Weight | Range |
|---|---|---|
| Black Dye | 8 | 6–15 |
| Filler | 10 | 0–64 |

Figure 2:
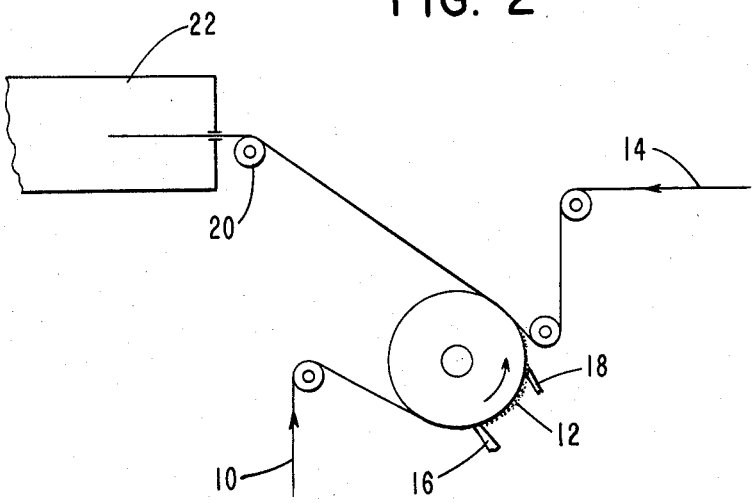
FIG. 2 is a diagrammatic view of a method of preparing the protective barrier of the present invention.

The thermally reactive coating is applied at a weight of 3 to 5 pounds per ream of base sheet 10, and the overlay sheet 14 is applied by the arrangement of FIG. 2, wherein the laminate is then dried and calendered. Calendering enhances the bond of the overlay sheet 14 to the support sheet 10 and increases the quality of the developed image.

The various ingredients utilized in the thermally reactive coating are further identified and are available from the noted sources. The polyvinyl alcohol (PVA) is available from Air Products Corporation, the bisphenol (4,4 . . . diphenol), as a reactant reactive material of the phenol group, is available from Dow Chemical Company, and the black dye is Pergascript from Ciba-Geigy Corporation. The amide wax is Armid HT from Armour Chemical Company and the filler is calcium carbonate supplied by Georgia Marble Company or the filler may be clay supplied by Engelhard Corporation.

It is thus seen that herein shown and described is a thermal sensitive sheet having means for protecting printed characters or images. The arrangement enables the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

We claim:

1. A thermosensitive sheet comprising a substrate, a thermally reactive coating on the substrate, the thermally reactive coating comprising a color forming dye, a wax, a bisphenol, and a binder, and a protective layer on the thermally reactive coating, the protective layer being capacitor tissue of a thickness to enable heat transfer therethrough for forming thermal images, and of translucent material to permit viewing of the thermal images.

2. A thermosensitive sheet comprising a substrate, a thermally reactive coating on the substrate, the thermally reactive coating comprising a color forming dye, a wax, a bisphenol, and a binder, and a protective layer on the thermally reactive coating, the protective layer comprising a capacitor tissue of about 8 to 10 microns in thickness to enable heat transfer therethrough for forming thermal images, and of translucent material to permit viewing of the thermal images.

* * * * *